US005523114A

United States Patent [19]

Tong et al.

[11] Patent Number: 5,523,114

[45] Date of Patent: Jun. 4, 1996

[54] SURFACE COATING WITH ENHANCED COLOR CONTRAST FOR VIDEO DISPLAY

[75] Inventors: Hua-Sou Tong, Arlington Heights, Ill.; Chun-Min Hu, Keelung; Yu-Chung Yu, Chungli; Ming-Yu Hsu, Ping-Cheng; Kuo-Chu Wang, Taipe, all of Taiwan

[73] Assignee: Chung Picture Tubes, Ltd., Taoyuan, Taiwan

[21] Appl. No.: 412,265

[22] Filed: Mar. 28, 1995

[51] Int. Cl.[6] ..... B05D 5/12

[52] U.S. Cl. ..... 427/68; 427/64; 427/164; 427/165; 427/379; 427/384

[58] Field of Search ..... 427/68, 384, 64, 427/379, 164, 165

[56] References Cited

U.S. PATENT DOCUMENTS

| | | | |
|---|---|---|---|
| 2,612,611 | 9/1952 | Szegho et al. . | |
| 2,680,205 | 6/1954 | Burton | 313/92 |
| 2,734,142 | 2/1956 | Barnes | 313/92 |
| 2,977,412 | 3/1961 | Rhodes et al. . | |
| 3,689,312 | 9/1972 | Long et al. . | |
| 4,884,006 | 11/1989 | Prazak, III | 313/474 |
| 4,885,501 | 12/1989 | Tong | 313/402 |
| 4,958,148 | 9/1990 | Olson | 340/712 |
| 5,011,443 | 4/1991 | Park | 445/2 |
| 5,150,004 | 9/1992 | Tong et al. | 313/479 |
| 5,200,667 | 6/1993 | Iwasaki et al. | 323/467 |

*Primary Examiner*—Janyce Bell
*Attorney, Agent, or Firm*—Emrich & Dithmar

[57] ABSTRACT

For use in a self-emitting color display device such as a cathode ray tube (CRT) having a display screen with a phosphor coating on its inner surface, a surface coating disposed on the display screen's outer surface affords improved color purity, or contrast, by reducing overlap in the color spectrum between two adjacent primary colors, i.e., between red and green and/or between green and blue. An organic dye is added to either an inner antistatic layer or an outer antireflective layer of an antireflective/antistatic outer coating on the display screen, where both of the aforementioned layers contain silane. The dye functions as a color filter absorbing only light within the frequency range between adjacent primary colors, such as between the red and green color phosphors, i.e., in the range of 460–500 nm, and/or between the green and blue color phosphors, i.e., in the range of 560–600 nm. A silane coupling agent is also added to serve as a binding agent bridging the organic dye and silane together. In this manner, the organic dye is bonded to the silane in either the antistatic layer or the antireflective layer to prevent separation and escape of the organic dye filter from either of these layers of the outer coating on the display screen.

16 Claims, 3 Drawing Sheets

SURFACE COATING WITH ENHANCED COLOR CONTRAST FOR VIDEO DISPLAY

FIELD OF THE INVENTION

This invention relates generally to self-emitting color video displays such as of the cathode ray tube (CRT) type and is particularly directed to a coating for the outer surface of the display screen of a color video display device which provides improved color separation and contrast.

BACKGROUND OF THE INVENTION

Self-emitting display devices, such as of the CRT type, provide a video image by the bombardment of phosphor elements disposed on the inner surface of the device's display screen by high energy electrons. The phosphor elements are separated into three groups, with each group emitting one of the primary colors of red, green or blue when impinged upon by the energetic electrons. For optimum color purity, the three groups of color phosphors should emit light characterized by three discrete spectra, with no overlap between adjacent spectral components. In practice, however, there is always some color spectrum overlap between adjacent primary color phosphors, i.e., between red and green as well as between green and blue. The spectral regions of overlap between red and green typically covers wavelengths in the range of 460–500 nm, while spectral overlap between the colors green and blue typically includes wavelengths in the range 560–600 nm. Any spectral overlap between the primary colors degrades video image color purity and color contrast.

U.S. Pat. No. 4,987,338 to Itou, et al. discloses an antistatic/antiglare coating in the form of a single layer to which an organic dye is added. This approach is not particularly desirable because the organic dye is subject to bleaching out of the coating when the faceplate is wiped with a wet cloth containing either water or alcohol. More recently, U.S. Pat. No. 5,291,097 to Kawamura, et al. teaches the addition of an organic dye to the inner antistatic layer of a double-layer antireflective/antistatic coating on the outer surface of the CRT's faceplate. The inner antistatic layer containing the organic dye is then covered with the outer antireflective layer. Even in this approach where the inner antistatic layer is covered by a protective outer antireflective layer, the organic dye has been observed to diffuse outwardly from the inner antistatic layer and through the outer antireflective layer, with the organic dye eventually bleaching out of the antireflective/antistatic coating on the faceplate through repeated wiping of the faceplate with either a dry or wet cloth.

The present invention addresses the aforementioned limitations of the prior art by permanently bonding an organic dye to silane in either the outer antireflective layer or the inner antistatic layer in preventing the bleaching of the dye from the surface coating. The organic dye functions as a color spectrum filter between two adjacent primary color phosphors so as to substantially eliminate primary color overlap resulting in improved color contrast and purity.

OBJECTS AND SUMMARY OF THE INVENTION

Accordingly, it is an object of the present invention to provide a surface coating for the outer surface of a self-emitting display device such as of the CRT type which provides improved color contrast for a video image presented on the display device.

It is another object of the present invention to provide an antistatic or antireflective coating for the outer surface of a CRT faceplate which provides improved color separation and thus enhanced color contrast in a video image.

Yet another object of the present invention is to introduce a color absorbing organic dye in the antistatic or antireflective coating of a CRT in a manner which permanently links the dye to the coating materials preventing bleaching of the dye from the coating and allowing the coating to also function as a color filter without degradation over time and with extensive use.

A further object of the present invention is to improve color contrast in the video image of a self-emitting display device by permanently affixing a color filter on the outer surface of the device's faceplate which substantially reduces spectral overlap of the three primary colors.

The present invention contemplates a coating for use on an outer surface of a glass faceplate of a self-emitting display device, wherein the glass faceplate further includes a phosphor coating on an inner surface thereof, and wherein the phosphor coming is responsive to energetic electrons incident thereon for providing three primary colors of red, green and blue, a coating comprising: an antireflective/antistatic layer disposed on the outer surface of the faceplate and containing silane; an organic color dye disposed in said antireflective/antistatic layer for absorbing light between two adjacent primary colors; and a silane binding agent disposed in the antireflective/antistatic layer for coupling the organic color dye to the silane in the layer.

BRIEF DESCRIPTION OF THE DRAWINGS

The appended claims set forth those novel features which characterized the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
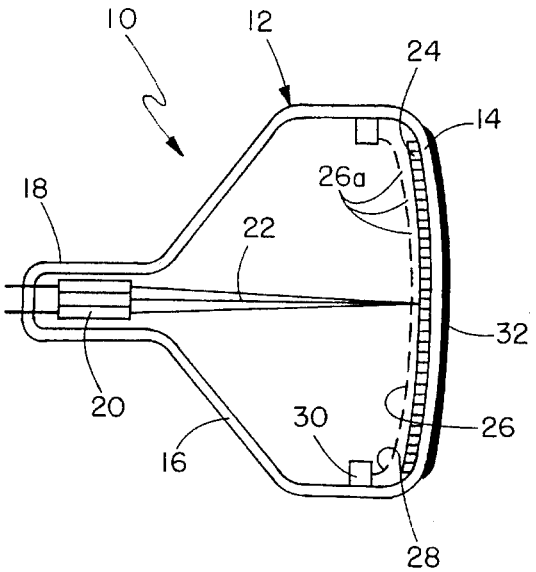
FIG. 1 is a longitudinal sectional, view of a CRT incorporating an antireflective or antistatic coating in accordance with the principles of the present invention.

Referring to FIG. 1, there is shown a sectional view of a color CRT 10 incorporating an antistatic/antirefiective coating 32 in accordance with the principles of the present invention. In the following discussion the terms "display screen", "display panel" and "faceplate" are used interchangeably. CRT 10 includes a sealed glass envelope 12 having a forward faceplate or display screen 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate. Color CRT 10 includes three electron beams 22 directed onto and focused upon the CRT's glass faceplate 14. Disposed in the neck portion 18 of the CRT's glass envelope 12 are a plurality of electron guns 20 typically arranged in an inline array for directing the electron beams 22 onto the phosphor screen 24. The electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and a mounting spring which also are not shown in the figure for simplicity. The shadow mask mounting fixture 30 may be a attached to the inner surface of the CRT's glass envelope 12 and the shadow mask 26 may be attached to the mounting fixture by conventional means such as weldments or a glass-based frit.

Figure 2:
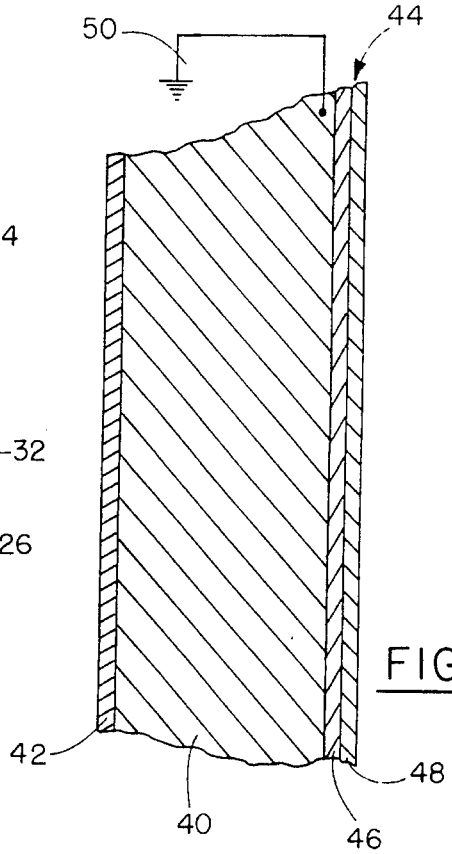
FIG. 2 is a partial sectional view of a flat display screen having an outer surface coating comprised of an inner antistatic layer and an outer antireflective layer in accordance with the present invention.

Referring to FIG. 2, there is shown a partial sectional view of a portion of a glass display panel, or faceplate, 40 having a phosphor layer 42 on the inner surface thereof and an outer coating 44 in accordance with the present invention on the outer surface thereof. The glass display panel 40 is shown in FIG. 2 as being flat, as the present invention is applicable to both curved and flat display screens. In addition, while the present invention has been described thus far in terms of use on the outer surface of the display panel of a CRT, the present invention is not limited to use with this type of display device. For example, the outer coating of the present invention may be used equally as well on the outer surface of the display panel of virtually any type of self-emitting color display device, i.e., where the video image is produced by phosphor activated by energetic electrons incident thereon. The phosphor layer 42 on the inner surface of the glass display screen 40 may be in the form of a large number of discrete dots or stripes. The outer coating 44 typically includes an inner antistatic layer 46 and an outer antireflective layer 48 which are described in detail below. A conductor 50 may be attached to the inner antistatic layer 46 or to the outer surface portion of the display screen 40 for electrically coupling the display screen to neutral ground potential.

Figure 3:
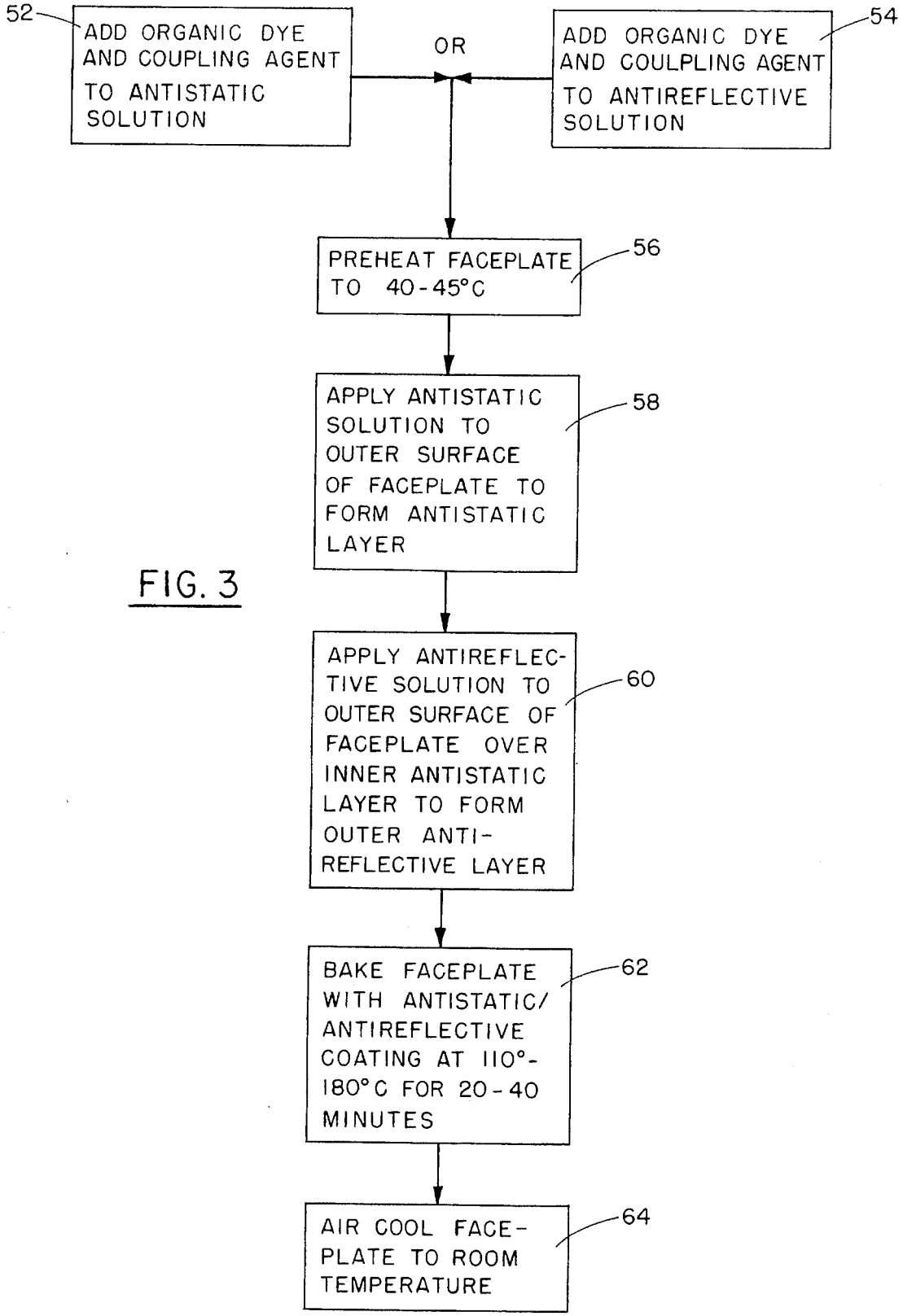
FIG. 3 is a flow chart illustrating the steps involved in preparing and applying the combination of an antistatic and antireflective coating to the outer surface of the faceplate of a self-emitting display device in accordance with the present invention.

Referring to FIG. 3, there is shown a flow chart of rite steps involved in preparing and applying the combination inner antistatic layer 46 and outer antireflective layer 48 forming the outer coating 44 on the display screen of a color CRT in accordance with the principles of the present invention. The process starts at either step 52 in the adding of an organic color dye and a silane coupling or binding agent to an antistatic solution or adding the organic color dye and silane coupling agent to an antireflective solution at step 54. The organic color dye and silane coupling agent combination may thus be added to either the inner antistatic layer or to the outer antireflective layer applied to the outer surface of the CRT's faceplate. The antistatic solution typically includes conductive metal oxides such as Sb-doped $SnO_2$, In-doped $SnO_2$, etc., and silane such as TCS (Tetrachloro Silane) or TES (Tetraethoxy Silane), and water. The antireflective solution applied as the outer layer to the outer surface of the CRT's faceplate typically includes silanes such as TCS or TES, water, etc. The coupling agent added to either the antistatic or antireflective solution serves as a binding agent bridging the organic color dye-and silane together. An azo, triarylmethane, or authraquinone dye, with acid substituents such as nitro, carboxy, or sulfonic acid may be employed as the organic dye.

By means of this reaction, the organic dye becomes bonded to the silane compound through the bridging of the silane coupling agent. The organic dye thus becomes permanently linked to the other coating materials in either the antistatic or antireflective layer. With the organic dye permanently bonded to the silane compound in the antistatic or antireflective layer, bleaching of the dye from the CRT's outer coating is thus prevented whether the dye is added to either the inner or to the outer layer on the surface of the CRT's glass faceplate.

The organic dye is added to either the antistatic or antireflective solution in the range of 0.1–25 wt %, with the silane coupling solvent added in the range of 0.1–20 wt %. As indicated above, the typical antistatic solution includes a conductive metal oxide, silane and water, while the typical antireflective solution also includes a silane, water and other alcohol-based solvent mixtures. At step 56, the faceplate is preheated to a temperature in the range of 40°–45° C. The outer surface of the faceplate is then covered with the antistatic solution at step 58 to form an antistatic layer. The coated outer surface of the faceplate is then further covered at step 60 with the antireflective solution over the inner antistatic layer to form an outer antireflective layer. The antistatic and antireflective layers may be applied by either a conventional spin or spray method. The faceplate with the inner antistatic layer and the outer antireflective layer is then baked at step 62 at a temperature of 110°–180° C. for 20–40 minutes and then air cooled to room temperature at step 64.

As an example of the present invention, an organic dye as described above was added to an antireflective solution in the amount of 0.5 wt %. The organic dye functioned as a light absorber in the range between 580–600 nm so as to remove overlap between the red and green spectra. 0.1 wt % of a silane coupling agent was added to 1 liter antireflective solution containing 1.0 wt % tetraethoxy silane and other solvents. The faceplate of the CRT was then heated to a temperature of 40° C., and was spin coated with a layer of antistatic solution containing 1.0 wt % of antimony doped tin oxide and other solvent. The antistatic coated faceplate was then dried and again preheated to 40° C. followed by spin coating of the antireflective layer over the inner antistatic layer using the solution described above. The faceplate was then baked at 180° C. for twenty minutes and then air cooled.

Figure 4:
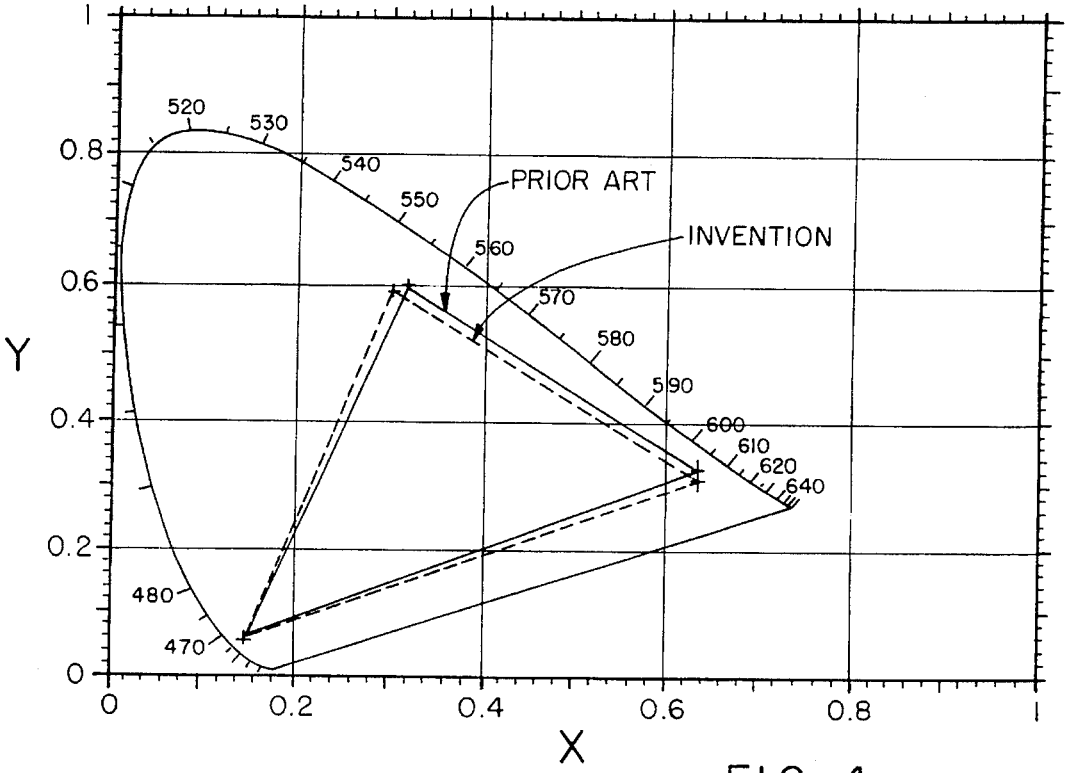
FIG. 4 is a CIE chromaticity diagram for the range of colors obtainable on a typical CRT display screen illustrating the filtering out of light in the wavelength range between 560–600 nm in accordance with one aspect of the present invention.

A color spectrum of the CRT faceplate coated with an inner antistatic layer and an outer antireflective layer having a light absorbing dye is shown in FIG. 4 which is a CIE chromaticity diagram representing the spectrum of colors displayed on a typical color CRT faceplate. The shift in the apices of the triangle shown in dotted line form illustrates that the red and green colors become noticeably purer as compared with a CRT faceplate without the light absorbing organic dye and silane coupling agent combination. After the data shown in FIG. 4 was taken, the coated faceplate was then dipped into boiling water for 5 minutes, with no evidence of dye bleaching occurring as observed by both the lack of color change of the water and a conventional cloth wiping test using both water and ethanol as a cleaning agent. The results shown in FIG. 4 are for a 1 liter antireflective solution containing tetraethoxy silane and other solvents to which has been added naphthol red dark (CI-12355) dye at 0.5 wt % and 0.1% Y-amino propyl triethoxy silane.

Figure 5:
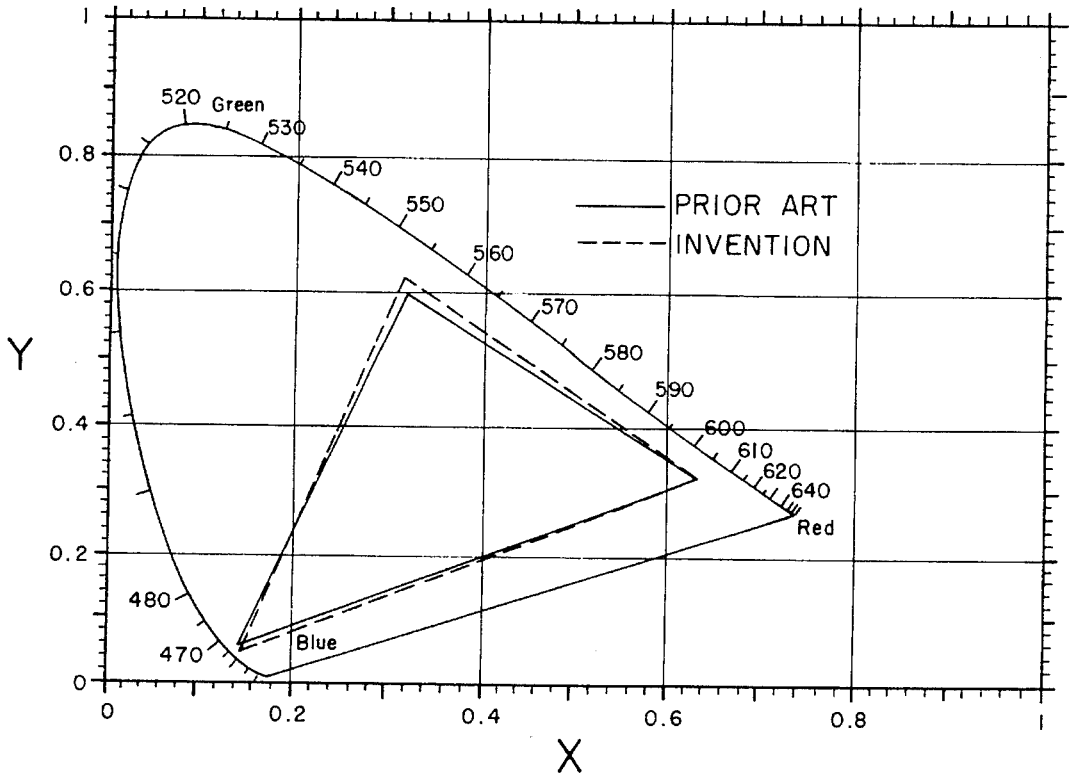
FIG. 5 is a CIE chromaticity diagram illustrating the range of colors obtainable in a typical CRT display screen illustrating the filtering out of light in the wavelength range between 460–500 nm in accordance with another aspect of the present invention.

A color spectrum of a CRT faceplate coated with an inner antistatic layer and a an outer antireflective layer having a light absorbing dye in accordance with another aspect of the present invention is shown in FIG. 5 which is CIE chromaticity diagram representing the spectrum of colors displayed on a typical color CRT faceplate. The results shown in FIG. 5 are for a 1 liter antireflective solution containing tetraethoxy silane and other solvents to which has been added naphthol Yellow S (CI-10316) dye at 0.5 wt % and 0.1% Y-amino propyl triethoxy silane. The shift in the apices of the triangle shown in dotted line form in FIG. 5 illustrates that the green and blue colors become noticeably purer as compared with the CRT faceplate without the light absorbing organic dye and silane coupling agent combination as shown by the triangle in solid lines in the figure. As in the case of the organic dolor dye for filtering light in the range between 580–600 nm as described above, there was no evidence of bleaching of the organic color dye from the antireflective layer in the coating used for absorbing light in the wavelength range of 480–550 nm as illustrated in FIG. 5 when the faceplate with its coating was dipped into boiling water and subjected to a wiping test with a cleaning agent. It should be noted here that the two aforementioned organic color dyes may both be added to either the antireflective coating or the antistatic coating to provide light absorption between the red and green color phosphors as well as between the green and blue color phosphors.

There are thus been shown a surface coating with enhanced color contrast for a self-emitting color display such as a CRT employing a light emitting phosphor coating responsive to energetic electrons incident thereon. The coating may be either in the form of an antireflective layer or an antistatic layer or a combination thereof, on the CRT's outer surface for filtering out light between the primary colors produced on the display screen, i.e., between the colors red and green and between the colors green and blue. An organic color dye is added to the coating layer in combination with a silane binding agent which couples the organic color dye to the silane in either the antireflective or antistatic layer. The dye functions as a color filter absorbing only light within the frequency range between adjacent primary colors, such as in the frequency range of 460–500 nm between the blue and green color phosphors, as well as in the range of 560–600 nm between the green and red color phosphors. The silane coupling agent serves as a binding agent bridging the organic color dye and silane together and preventing separation and escape of the organic color dye from either of these layers of the outer coating on the display screen.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use on an outer surface of a glass faceplate of a self-emitting display device, wherein said glass faceplate further includes a phosphor coating on an inner surface thereof, and wherein said phosphor:coating is responsive to energetic electrons incident thereon for providing three primary colors of red, green and blue, a coating comprising:

an antireflective/antistatic layer disposed on the outer surface of said faceplate and containing silane;

at least one organic color dye disposed in said antireflective/antistatic layer for absorbing light between two adjacent primary colors; and a silane binding agent disposed in said antireflective/antistatic layer for coupling said at least one organic color dye to the silane in said layer, wherein said silane binding agent is Y-amino propyl triethoxy silane.

2. The coating of claim 1 wherein said at least one organic color dye is an azo, triarylmethane, or authraquinone dye with acid substituents.

3. The coating of claim 2 wherein said acid substituents include a nitro, carboxy or sulfonic acid.

4. The coating of claim 1 comprised of 0.1–25 wt % of said at least one organic color dye.

5. The coating of claim 1 comprised of 0.1–20 wt % of said silane binding agent.

6. The coating of claim 1 wherein said organic color dye is naphthol yellow S dye for absorbing light in the wavelength range of 480–500 nm or naphthol red dark dye for absorbing light in the wavelength range of 580–600 nm.

7. The coating of claim 1 further including first and second organic color dyes disposed in said antireflective/antistatic coating for absorbing light between the primary colors of red and green and between the primary colors of green and blue.

8. The coating of claim 1 wherein said antireflective/antistatic coating includes an inner antistatic layer and an outer antireflective layer each containing silane, and wherein said organic color dye and said silane binding agent are disposed in either said inner antistatic layer or said outer antireflective layer.

9. The coating of claim 8 further comprising first and second organic color dyes for absorbing light between the red and green primary colors and between the green and blue primary colors.

10. A method for preparing and applying a coating with enhanced color contrast to an outer surface of a video display panel whereon are presented the primary colors of red, green and blue, said method comprising the steps of:

adding a combination of anorganic color dye and a silane binding agent to a coating solution containing silane in forming a bond between said organic color dye and said silane and preventing removal of said organic color dye from said coating solution, wherein said organic color dye absorbs light between and enhances spectral separation between two adjacent primary colors and wherein said silane binding agent is Y-amino propyl triethoxy silane;

preheating the video display panel to a first temperature;

applying said coating solution containing said organic color dye and silane binding agent combination to an outer surface of the video display panel;

heating the video display panel with said coating solution to a second temperature for a time period, wherein said second temperature is greater than said first temperature; and air cooling the video display panel to room temperature.

11. The method of claim 10 wherein said organic color dye is an azo, triarylmethane, or authraquinone dye with acid substituents.

12. The method of claim 11 wherein said acid substituents include a nitro, carboxy or sulfonic acid.

13. The method of claim 12 wherein said organic color dye is naphthol yellow S dye for absorbing light in the wavelength range of 480–500 nm or naphthol red dark dye for absorbing light in the wavelength range of 580–600 nm.

14. The method of claim 11 wherein said first temperature is in the range of 40°–45° C.

15. The method of claim 14 wherein said second temperature is in the range of 110°–180° C. and said predetermined time period is in the range of 20–40 minutes.

16. The method of claim 10 further comprising the steps of forming the coating by adding the combination of said organic color dye and silane binding agent to a first antistatic coating solution or a second antireflective coating solution, followed by preheating the video display panel, applying the first antistatic coating solution to the outer surface of the video display panel and applying the second antireflective coating solution to the first antistatic coating solution.

* * * * *

UNITED STATES PATENT AND TRADEMARK OFFICE

CERTIFICATE OF CORRECTION

PATENT NO. : 5,523,114

DATED : June 4, 1996

INVENTOR(S) : HUA-SOU TONG, CHUN-MIN HU, YU-CHUNG YU, MING-YU HSU and KUO-CHU WANG It is certified that error appears in the above-indentified patent and that said Letters Patent is hereby corrected as shown below:

Column 3, line 58, "rite" should be — the —.

Column 6, line 50, "anorganic" should be — an organic —.

Column 8, lines 1-2, "predetermined" should be — selected —.

Signed and Sealed this

Twentieth Day of August, 1996

Bruce Lehman

*Attest:*

BRUCE LEHMAN

*Attesting Officer*

*Commissioner of Patents and Trademarks*